United States Patent [19]

Scully

[11] 4,396,089

[45] Aug. 2, 1983

[54] SOUND MUFFLING CUP

[76] Inventor: Monya Scully, 11 Gay St., New York, N.Y. 10014

[21] Appl. No.: 325,178

[22] Filed: Nov. 23, 1981

Related U.S. Application Data

[63] Continuation of Ser. No. 152,004, May 21, 1980, abandoned.

[51] Int. Cl.[3] ..... F01N 7/08

[52] U.S. Cl. ..... 181/242

[58] Field of Search ..... 179/187, 188; 181/21, 181/22, 198, 242

[56] References Cited

U.S. PATENT DOCUMENTS

| | | | |
|---|---|---|---|
| 1,776,584 | 9/1930 | Gerlach, Jr. | 181/242 |
| 2,540,873 | 2/1951 | Florman | 179/188 |
| 2,558,278 | 6/1951 | Stone et al. | 179/188 X |
| 2,769,040 | 10/1956 | Mattia | 179/188 |
| 2,798,122 | 7/1957 | Ungarsohn | 181/242 X |
| 3,244,816 | 4/1966 | Karns | 181/198 X |
| 4,129,754 | 12/1978 | Gore | 181/242 X |

*Primary Examiner*—L. T. Hix
*Assistant Examiner*—Thomas H. Tarcza
*Attorney, Agent, or Firm*—Sprung, Horn, Kramer & Woods

[57] ABSTRACT

The invention is directed to providing a sound muffling cup into which an enraged person can shout to release tension while avoiding disturbing other persons. The cup comprises an elongated body portion having a substantially closed end wall at one end, and brim shaped to provide a mouthpiece at the other end. The body portion is of a size such that the fingers can be at least partially wrapped around the body portion for holding of the cup, and the mouthpiece is of a size and contour such that it can be place over the mouth with substantially the entire brim contacting the skin along a generally elliptical line spaced from the lips and on the mouth side of the nose and chin.

5 Claims, 5 Drawing Figures

SOUND MUFFLING CUP

This is a continuation of application Ser. No. 152,004, filed May 21, 1980, now abandoned.

BACKGROUND

The invention provides a sound muffling cup into which an enraged person can shout to release tension while at the same time avoiding disturbing other persons.

It is a fact of life that many people in a state of anger shout, often at children, a spouse, a dog, etc. with the motivation being not to communicate, but rather mere anger. Where the cause is anger, and the aim is not communication, I have found that a sound muffling cup into which the angered person can shout, is very effective in that the shouting still releases the anger, disturbing of other persons is avoided. Also, the use of the cup may result in avoidance of embarrassment as is experienced by many after having disturbed others by shouting in a fit of anger.

My investigation has disclosed devices for use on telephones intended to convey sound waves to the phone pick-up device while otherwise limiting sound propagation. Such devices are disclosed in the following patents: Clarke, U.S. Pat. Nos. 1,004,995; Cohane, 1,444,494; Alford et al. U.S. Pat. No. 2,390,488; and Veneklasen, U.S. Pat. No. 2,456,346. My device is intended to eliminate all propagation from the cup to the extent that such is practical. Another sound muffling device is disclosed in Gerlach, U.S. Pat. No. 1,776,584, entitled Vocalizing Muffler. The Gerlach device is a hollow bent tube, mounted on a floor stand. One desiring to practice singing sings into the upper end of the tube. There are baffles in the tube, and the tube terminates in an open bottom. Here, it seems, the objective is to reduce rather than to eliminate propagation. Karns, U.S. Pat. No. 3,244,816, discloses an audio training device which is intended for vocal exercise without disturbing others. A sound isolation chamber receives the sound, and provides muffling, while an amplifier is connected to the chamber, and also to earphones worn by the person using the device. Finally, Strobach, in U.S. Pat. No. 2,657,609, discloses a sound isolation chamber designed to receive a musical instrument, for example, a saxophone. The mouthpiece of the saxophone protrudes from the chamber, so that the instrument can be played while the chamber is in place to muffle the sound generated by the instrument.

THE INVENTION

As already mentioned, the invention is directed to providing a sound muffling cup into which an enraged person can shout to release tension while avoiding disturbing other persons. My cup comprises an elongated body portion having a substantially closed end wall at one end, and a brim shaped to provide a mouthpiece at the other end. The body portion is of a size such that the fingers can be at least partially wrapped around the body portion for holding of the cup, and the mouthpiece is of a size and contour such that it can be placed over the mouth with substantially the entire brim contacting the skin along a generally elliptical line spaced from the lips and on the mouth side of the nose and chin. The body portion is preferably of a size such that with the fingers wrapped around the cup the the thumb and index finger substantially meet. While the body portion can have a lining formed of sound absorbing material, and the sound absorbing material can be perforated to provide improved sound absorbtion, I have found that a simple cast, shape retaining, substantially rigid plastic material, without a lining and perforations, is effective for the purposes of the invention.

By sound absorbing material, I mean a material absorbing sound better than cast polyethylene.

If desired, the entire cup i.e., the side wall and end wall could be formed of a material which is perforated to improve sound absorbtion. The presence, however, of perforations or openings as would increase sound propagation from the cup, is to be avoided.

The body portion can be hollow, and may contain any desired structure for improving sound absorbtion or the aesthetic appearance of the cup. The cup need only have an open area adjacent the brim to permit the necessary movement of the lips. The cup can be formed by any of a large number of materials including cast plastic, wood, glass, etc. The material should withstand washing as the usual kitchenware does.

This device of the invention breaks, distorts, compresses and muffles the sound waves so that vocal sounds at close range are hardly audible and are effectually subdued and are not understood. Desirably, an internal structure is provided within the cup for reducing or eliminating sound tending to emanate from the cup. The internal structure can be a lining of sound absorbing material or a structural array of ribs or baffles for for muffling of the sound.

THE DRAWINGS

Embodiments of the invention are illustrated in the accompanying drawings, of which:

Figure 1:
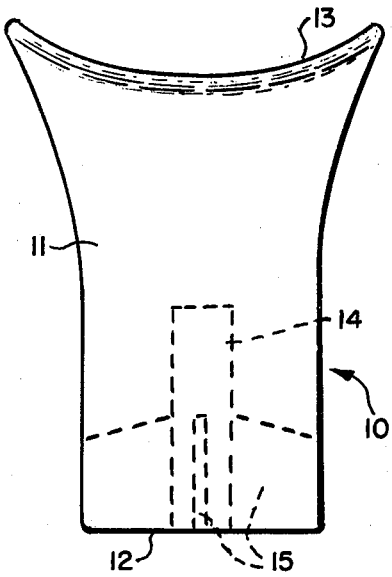
FIG. 1 is an elevation view of a sound muffling cup according to the invention.
Figure 2:
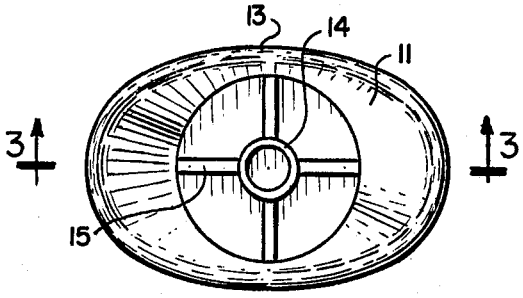
FIG. 2 is a top view of the device shown in FIG. 1.
Figure 3:
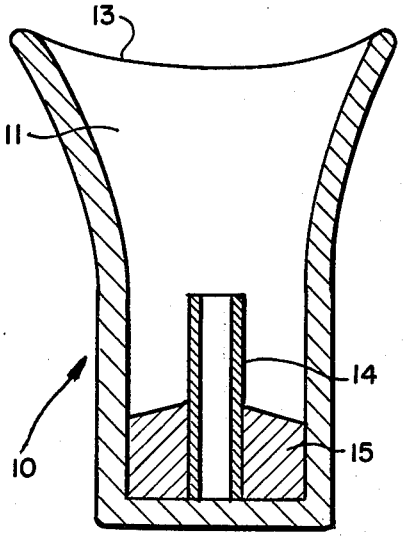
FIG. 3 is a cross sectional view taken along line 3—3 in FIG. 2.

Referring to FIGS. 1–3, the muffling cup 10 comprises an elongated, substantially hollow body portion 11 having a substantially closed end wall 12 at one end, and a brim 13 shaped to provide a mouthpiece at the other end.

Figure 5:
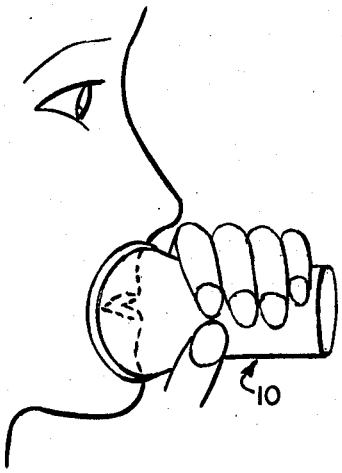
FIG. 5 is a view showing the muffling cup in use.

As is indicated in FIG. 5, the body portion is of a size such that the fingers can be at least partially wrapped around the body portion for holding of the cup, and the mouthpiece is of a size and contour such that it can be placed over the mouth with substantially the entire brim contacting the skin along a generally elliptical line spaced from the lips on the on the mouth side of the nose and chin.

Desirably, when the cup is held by being gripped by the fingers, the thumb and index finger substantially meet as is indicated in FIG. 5. Thus it is contemplated that the thumb and index finger are spaced a short distance, meet, or overlap a short distance.

In the embodiment of FIGS. 1–3, an internal structure comprising a hollow tube 14, and spaced, radial ribs 15, is contained within the cup. That structure is provided to entrap, compress or deaden the sound waves and to reduce or eliminate the sound tending to emanate from the cup.

Figure 4:
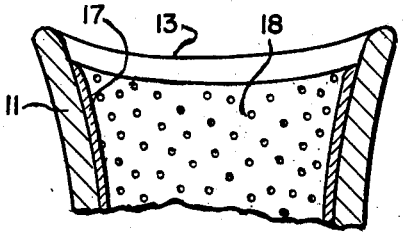
FIG. 4 is a partial view of another embodiment.

In the embodiment shown in FIG. 4, the cup is provided with a lining 17 which is a sound absorbing material, having perforations 18. The lining could be a perforated soft vinyl plastic. However, any perforated lining or internal structure which would make washing difficult would be undesirable. From that standpoint a cup free of internal structure, perforations and cellular elements, and formed of a material which withstands repeated washing, is preferred.

What is claimed is:

1. Sound muffling cup into which an enraged person can shout to release tension while avoiding disturbing other persons, comprising an elongated body having a closed end wall at one end and a brim shaped to provide an open mouthpiece at the other end, a first body portion adjacent said closed end wall being of a size such that the fingers can be at least partially wrapped around said first body portion for holding the cup, said mouthpiece being of a size and contour such that it can be placed over the mouth with substantially the entire brim contacting the skin along a generally eliptical line spaced from the lips and on the mouth side of the nose and chin, a second body portion adjacent said mouthpiece diverging from said first body portion to the brin and being coaxial with said first body portion, an axially disposed hollow tube mounted on said closed end portion and having an open end facing said open mouthpiece, and four rib-baffles substantially equally spaced apart from each other and extending radially from said hollow tube to said first body portion, whereby sound waves are trapped and compressed by the fins and the tube so that they are hardly audible at close range.

2. Sound muffling cup of claim 1, the body portion being of a size such that with the fingers wrapped around the cup, the thumb and index finger substantially meet.

3. Sound muffling cup of claim 1, the cup being formed of a shape retaining plastic.

4. Sound muffling cup of claim 1 further including a lining of sound absorbing material.

5. Sound muffling cup of claim 2 wherein said liner is formed of soft perforated vinyl plastic.

* * * * *